United States Patent [19]

Koelsch

[11] Patent Number: 4,847,485

[45] Date of Patent: Jul. 11, 1989

[54] ARRANGEMENT FOR DETERMINING THE NUMBER OF PERSONS AND A DIRECTION WITHIN A SPACE TO BE MONITORED OR A PASS-THROUGH

[76] Inventor: Raphael Koelsch, c/o MBB GmbH, P.O. Box 801109, 8000 Muenchen 80, Fed. Rep. of Germany

[21] Appl. No.: 177,523

[22] PCT Filed: Jul. 13, 1987

[86] PCT No.: PCT/DE87/00314

§ 371 Date: Apr. 21, 1988

§ 102(e) Date: Apr. 21, 1988

[87] PCT Pub. No.: WO88/00740

PCT Pub. Date: Jan. 28, 1988

[30] Foreign Application Priority Data

Jul. 15, 1986 [DE] Fed. Rep. of Germany ..... 3623792

[51] Int. Cl.[4] ..... G08B 13/18

[52] U.S. Cl. ..... 250/221; 250/342; 340/567; 377/6; 377/53

[58] Field of Search ..... 250/221, 342, 338.3; 340/555, 556, 565, 567; 377/6, 53

[56] References Cited

U.S. PATENT DOCUMENTS

| | | | |
|---|---|---|---|
| 3,727,034 | 4/1973 | Pope | 377/6 |
| 4,009,389 | 2/1977 | Lindholm | 250/221 |
| 4,278,878 | 7/1981 | Kato | 377/53 |
| 4,356,387 | 10/1982 | Tsubata et al. | 377/6 |
| 4,528,679 | 7/1985 | Shahbaz et al. | 377/6 |
| 4,554,459 | 11/1985 | Tsutsumi et al. | 250/221 |
| 4,745,284 | 5/1988 | Masuda et al. | 250/342 |
| 4,746,910 | 5/1988 | Pfister et al. | 340/567 |
| 4,760,381 | 7/1988 | Haag | 250/221 |

FOREIGN PATENT DOCUMENTS

| | | |
|---|---|---|
| 2542594 | 4/1976 | Fed. Rep. of Germany . |
| 2920333 | 1/1980 | Fed. Rep. of Germany . |
| 3030229 | 8/1980 | Fed. Rep. of Germany . |
| 143225 | 8/1983 | Japan . |
| 1252253 | 11/1971 | United Kingdom . |

*Primary Examiner*—Edward P. Westin

*Attorney, Agent, or Firm*—W. G. Fasse; D. H. Kane, Jr.

[57] ABSTRACT

In an installation for determining the number of persons inside a monitored room or so-called pass-through, a sensor field is generated by IR-sensors. An evaluation unit uses as discriminating criterion the detection of moving bodies and generates for an entrance control unit a signal, allowing or barring the entrance of a person.

2 Claims, 6 Drawing Sheets

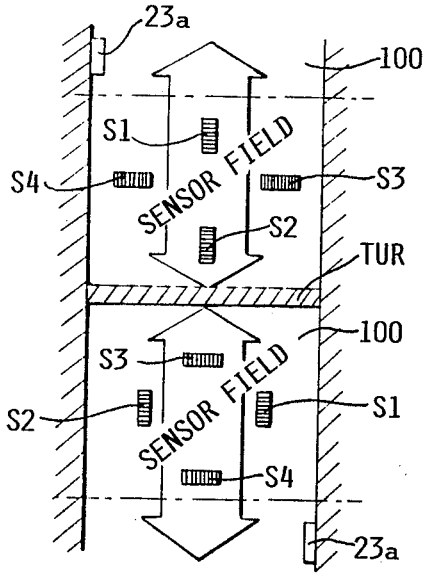
FIG.1a
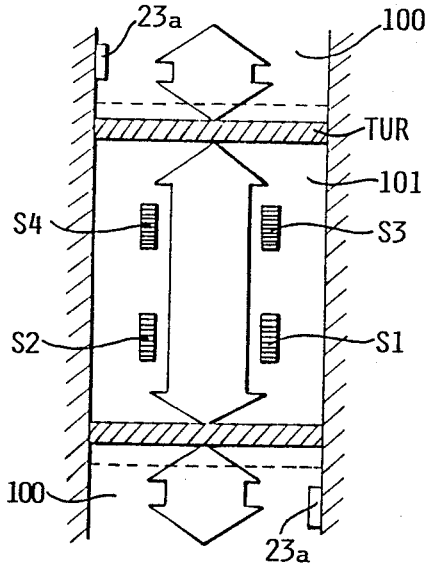
FIG.1b
FIG.1c
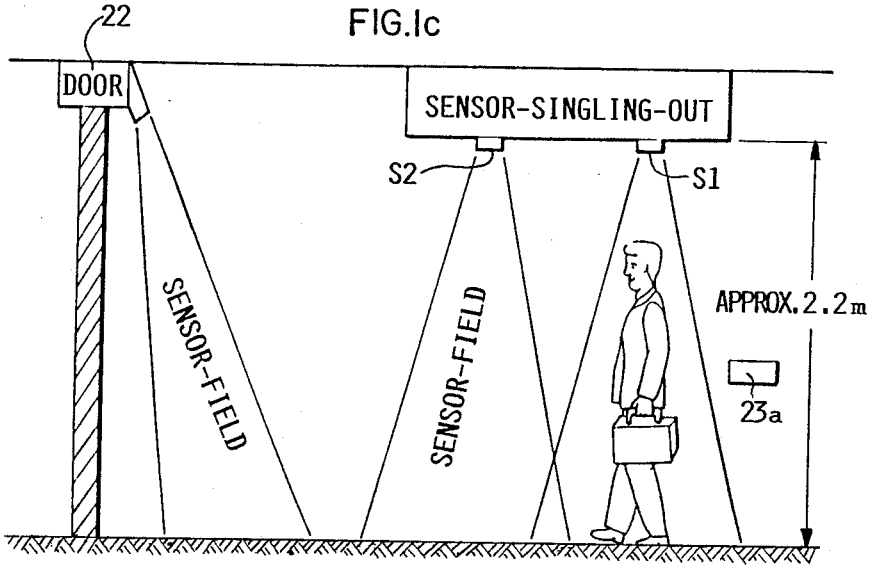

$$U_{Rel} = \frac{U_B - 0{,}6V}{2} \qquad U_A = U_{Rel} \pm \Delta U_A$$

ARRANGEMENT FOR DETERMINING THE NUMBER OF PERSONS AND A DIRECTION WITHIN A SPACE TO BE MONITORED OR A PASS-THROUGH

The invention relates to an arrangement for determining the number of persons and a direction within a space to be monitored according to the preamble of claim 1.

In the prior art, it is attempted to achieve the so-called "singling-out" in the known control systems in that firstly the so-called sluice room or pass-through is maintained structurally narrow or tightly limited, and secondly, that the pass-through is closed off by means of two mutually locked doors, or in that the undesirable simultaneous admission of a second person is prevented by means of weight testing. In the first named case, the so-called rotatable locking turnstiles are known which are only made functional after an identification card check by an identification reader. Instead of identification cards, for example at large sporting events, the entry ticket is inserted into the reader slot. By carrying a second person on the shoulders, such singling-out devices may be easily deceived. Estimates indicate that between 14 and 18% unauthorized persons enter in this manner.

If the singling-out arrangement involves a closed narrow sluice room or pass-through, then claustrophobia results for a large number of visitors, so that an arrangement which functions in this manner is already rejected by the company personnel counselor.

The situation is similar for the known narrow pass-throughs which are closed by two doors, whereby after the entry door has been closed, the exit door automatically opens. Here, the difficulty additionally arises that the narrow sluice room or pass-through becomes a "prison" during functional troubles which, for example, arise due to power failure, etc., and therefore, additional emergency call arrangements, door opening devices which become active during a power failure, and the like become necessary.

If, however, in the above mentioned instances the sluice room or pass-through is made wider, then the simultaneous entry of two people is no problem, and the security arrangement is very easy to overcome.

In the embodiment in which the singling-out is carried out by means of a weight control via tread boards, etc, an outsmarting by two persons is similarly relatively easy because the prescribed weight tolerance must be maintained very high so that it is no problem, for example, that two slender women can enter simultaneously, or an adult person and a youth. Besides that, in all of the above mentioned cases the technical effort and expense is very considerable.

German Patent Publication (DE-OS) 2,542,594 discloses an arrangement for determining the number and direction of persons within a space to be monitored or a pass-through, especially the double door of a vehicle, in which at least two IR-sensors and an evaluating unit are used for determining the number of persons passing through. An active system is used for the detection, namely, a light barrier system with transmitters and receivers. This has the advantage that the space region being monitored is exactly defined by the transmitting region and is therefore relatively easily circumventable, or must be held small enough by mechanical boundaries, which is however, not a problem in the described range of applications.

It is the object of the present invention to embody the known arrangements for determining the number and direction of persons in such a manner that an increased security against the fradulent entry by persons is achieved, without requiring that the monitoring region be excessively narrowed by means of walls.

This object is achieved by means of the measures defined in the characterizing clause of claim 1. Advantageous embodiments are set forth in the dependent claims, and example embodiments are dealt with in the following description and are shown schematically in the figures of the drawing, wherein:

FIG. 1*a* is a top view onto a wide passage of which the door is opened by an identification reader arranged on both sides;

FIG. 1*b* is a top view onto a wide corridor which possesses a sluice room or pass-through closed by two doors and each door is opened by an identification reader and the respective entry door is automatically closed after passing a light barrier;

FIG. 1*c* is a schematic view of a sluice room with the suggested singling-out by a sensor;

FIG. 2*a* is a diagram of a sensor output signal from an IR-sensor according to the described example embodiments;

FIG. 2*b* is a diagram of the output signal of various situations as they are formed by so-called PID-11-sensors;

Figure 2A:
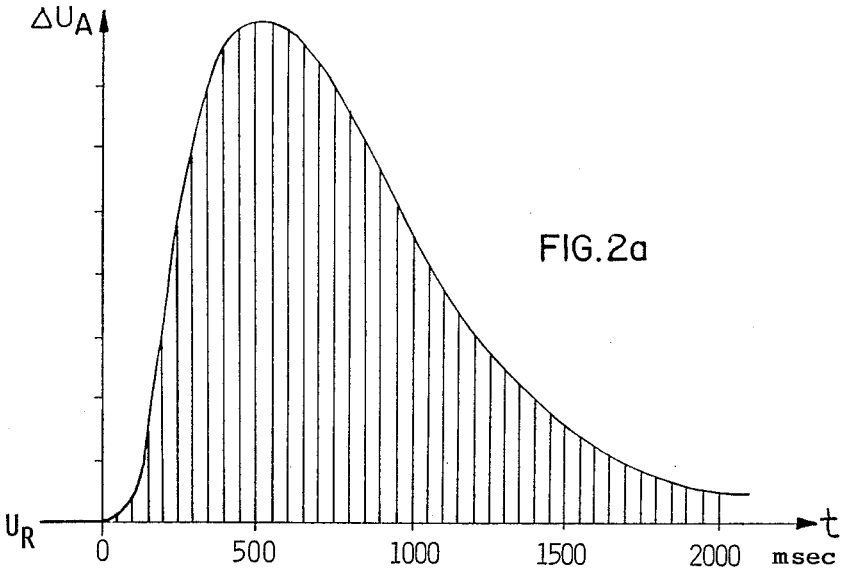

The general idea of the invention intends to provide a reliably functioning singling-out for existing passage security systems which is no longer limited to narrow spaces. In this context it should be possible to reliably carry out the detection and the evaluation with readily available components. The integration into existing entry control systems is effortlessly possible and is adaptable to the respective security relevance and user frequency. Furthermore, it is important here that the release to permit passage is made dependent on the evaluation of the sensor signals suggested here.

In this context it is suggested that one or more infrared sensors $S_1$ to $S_n$ detects or detect the deviations of the ambient temperature from a body temperature and that the determined values are input to an evaluating unit 10. This evaluating unit now determines the number of persons present in the sluice or in the pass-through etc. Evaluation takes into account the temperature changes over time which result due to the running or walking speed of a person passing through, the energy output from the IR-sensors $S_{1-Sn}$, and the sensor spacing. These values formed by the evaluating unit 10 are now supplied to the—as the case may be already existing—entry control unit for further processing.

Various arrangements and example embodiments are shown in FIGS. 1*a* to 1*c*. In FIG. 1*a* a pass-through room 100 is closed by a door. This door may be opened from both directions by means of a so-called identification reader 23*a*. So far, the entry control is as given by the state of the art. Now naturally this wide passageway can be simultaneously used by a larger number of persons, only one person needs to insert his or her identification card into the reader and the thus released and opened door may be held open for following persons, which is generally also done at the beginning of work. An effective control is thus not achieved. By means of the singling-out arrangement according to the invention, an effective control is also possible for such an apparatus because now, by means of the IR-sensors, each person who enters into the sensor field 101 generated by the person, is registered. Now the entry control arrangement which causes the opening of the door after reading the identification, can be programmed without problems in such a manner that an opening of the door is not carried out if two persons are detected within the sensor field 101.

The illumination of the IR-sensors $S_1$, $S_2$ that is, of the sensor field, may now be achieved by an appropriate number of equal commercially available IR-sensors, whereby these may also be arranged differently in their positions relative to one another. In FIG. 1*a* the sensors are attached in pairs behind one another and perpendicular to one another, as seen in the passage direction, to the ceiling of the room.

In FIG. 1*b* a closed sluice room is illuminated by two sensor pairs arranged behind one another. In FIG. 1*c* a schematic view is shown which illustrates the passing by a person of a sensor field illuminated by IR-sensor lobes. By means of this or similar sensor arrangements, also the direction of motion of the passing person may now be simultaneously determined. By means of the arrangement of the sensors placed next to one another or laterally with respect to one another, an out-smarting of the thermal radiation is prevented and a redundance is given.

Figure 3:
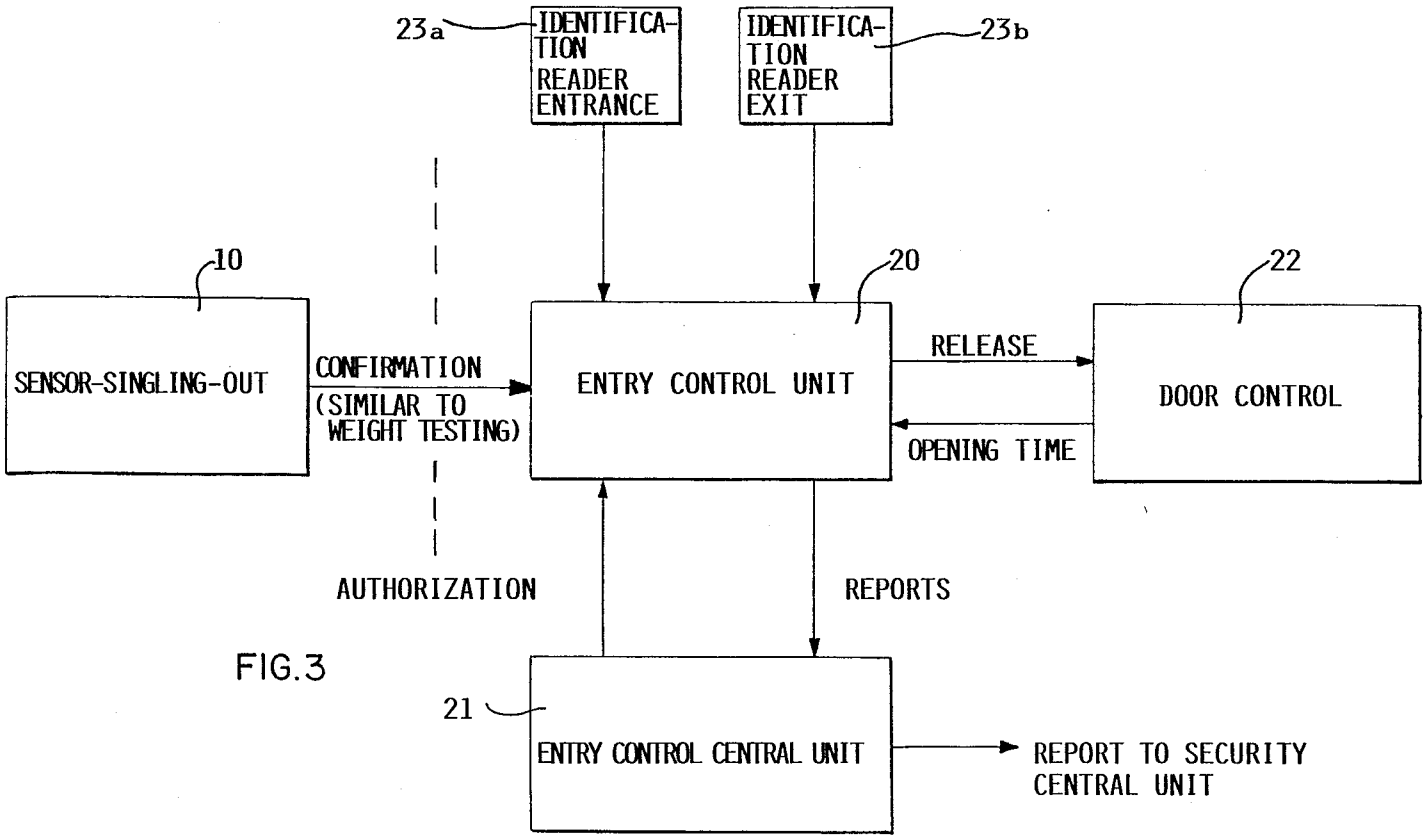
FIG. 3 is a block circuit diagram of a security arrangement provided with the singling-out according to the invention.
Figure 4:
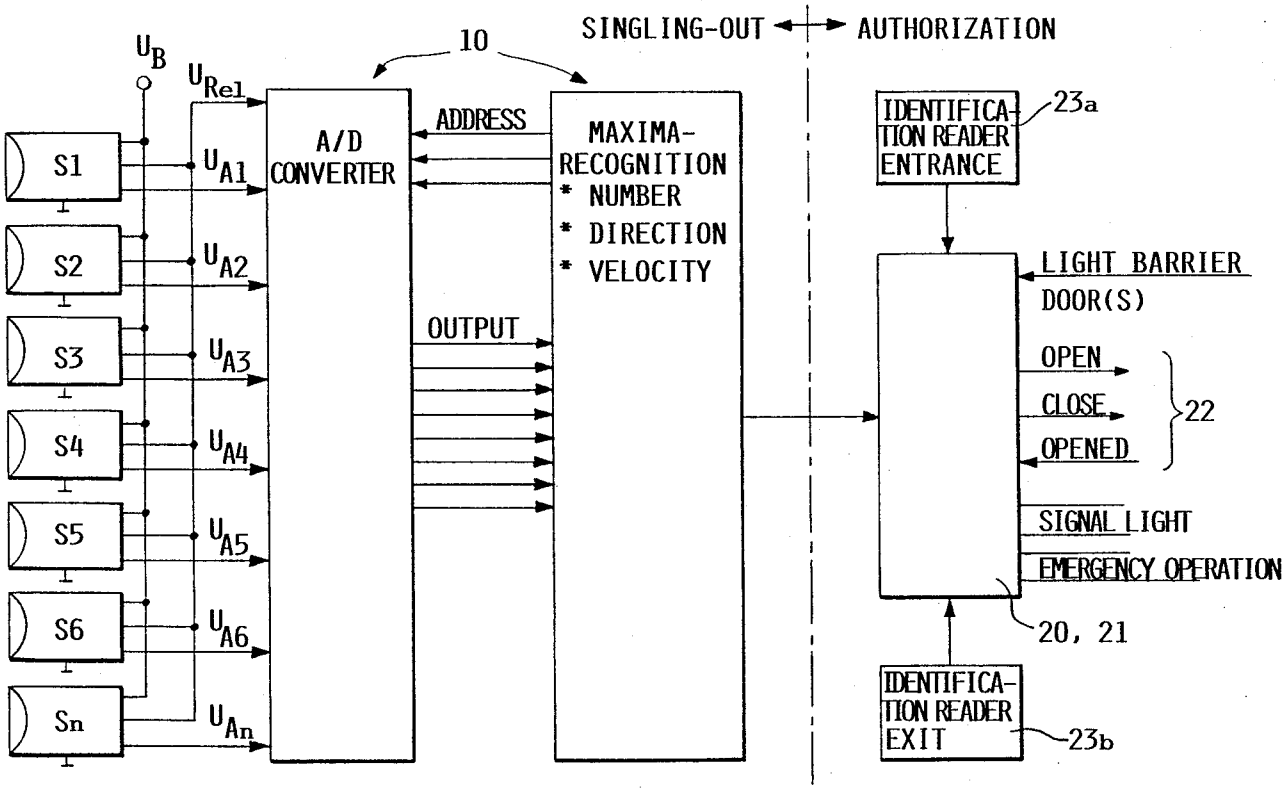
FIG. 4 is a block circuit diagram of the suggested singling-out arrangement with connection to the available or freely selectable security arrangement in an example embodiment.

FIGS. 3 and 4 illustrate in block circuit diagrams the construction and circuiting of the arrangement according to the invention with the entry control systems at hand. The sensor singling-out or rather its evaluating unit 10 supplies its signal to the entry control unit 20 which—in the given example—is activated by an identification reader 23*a*, 23*b*. This unit 20 asks the entry control central unit 21 if the identification holder is authorized for passage, and after confirmation by the sensor singling-out 10, that only one person is involved, it gives the opening signal to the door control 22. If now, a person who has not operated the identification reader is present in the sensor field 101, then the sensors indicate this fact to the entry control unit 20, which reports it to the entry control central unit 21, which in turn informs central security of this fact or causes an alarm. The circuit diagram of FIG. 4 should be so understandable that it requires no further explanation, especially since all the structural elements shown are freely obtainable shelf items.

For the evaluation of the sensor signals, it should still be mentioned that the progression of the sensor signal is dependent upon the time dependent temperature variations. That means that the velocity and the emitted energy is determined based on the deviation of the body temperature from its surroundings. As further values, the operating voltage and the distance to the sensor have an influence and are to be taken as constant values.

Now in order to keep the effect of the velocity on the signal width small, a minimum velocity may be fixed or be given as a basis to the evaluation circuit. For the control, the velocity v may be determined from the spacing between the maxima and the spacing between the sensors. The ambient temperature is continually monitored and used for the calculations. Thus, an absolutely reliable signal may be obtained from the spacial conditions, the ambient temperature, the sluice temperature, the body temperature, and the velocity, which makes an entering of the sluice by a second person nearly impossible.

As already mentioned, FIG. 2*a* shows a sensor output signal $U_A$ which has an invariable value when no persons are detected. It can also be said that: the sensor output signal voltage $U_A$=the fixed selected reference voltage $U_R$ when no one is detected.

In the diagram, $\Delta U_A$ means the voltage difference between the ambient temperature and the detected temperature of a person. In this context, it is to be further mentioned that an object having the same radiation as the temperature of the environment can only be detected if the sensor is artificially held to a temperature deviating by at least 5° C.

Figure 2B:
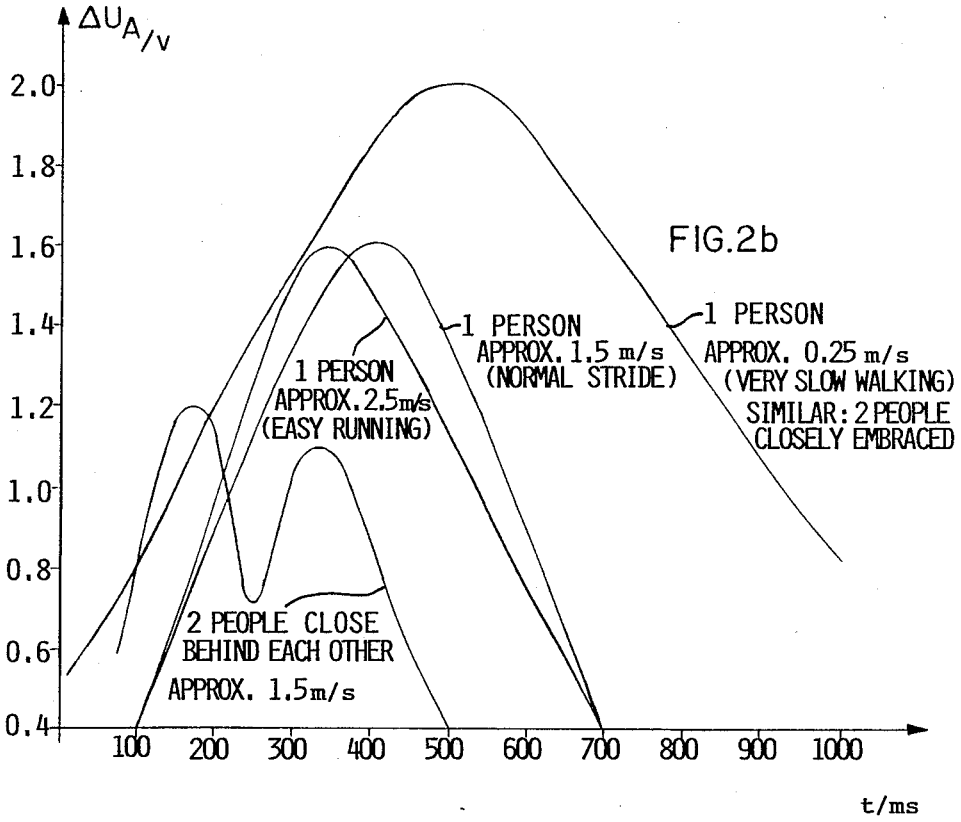

FIG. 2*b* shows the parameters for various situations, whereby these were achieved by means of two PID-11-sensors which were arranged at a spacing of 0.5 m relative to one another. The spacing from the sensors to the person similarly amounted to approximately 0.5 m.

Figure 5:
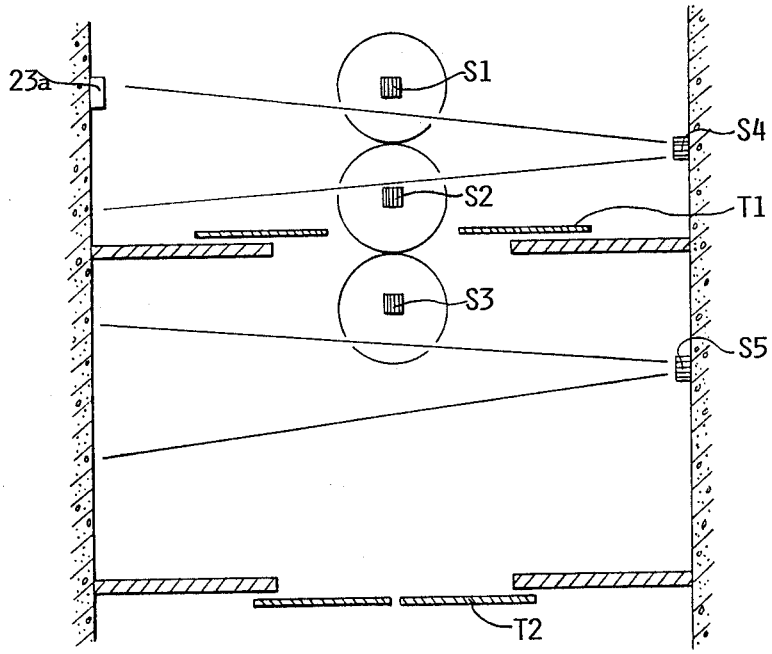
FIG. 5 is schematically a sluice arrangement according to the invention with two sliding doors.

FIG. 5 schematically shows a sluice arrangement with two sliding doors T1 and T2. For a normal operation these doors only open to a determined width so that an additional protection against unauthorized passage is given.

In order to be able to use the doors as an escape route they may simultaneously be opened to the full width by means of an appropriate switching possibility. The complete opening also allows the transport of bulky objects.

Figure 6:
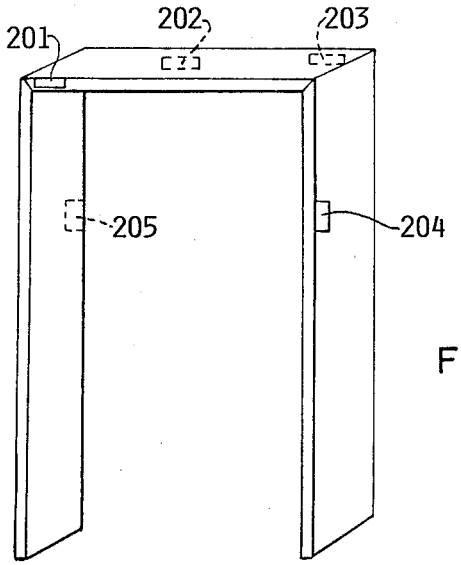
FIG. 6 is a further arrangement of the sensor.

FIG. 6 shows a further advantageous possibility for the IR-sensors, namely, an asymmetrical arrangement. Thereby, the spacing of the side sensors 204 and 205 from the floor is selected so that only the head and shoulder body parts, which move uniformly in comparison to the arms and legs, are detected by the sensors. This makes it possible to clearly differentiate the signal progression of two persons as compared to one person by means of the detected person velocity. This is also true for the case when persons walking behind one another closely embrace each other.

The sensors 201, 202, and 203 arranged similarly asymmetrically overhead in this configuration allow an unambiguous declaration whether a second person is passing through the sluice hidden by the first person from the view of the sensors 204 and 205.

This is achieved by means of the distribution of the detectable body heat. The signal progressions of 201, 202, and 203 show a uniform distribution for a single person which is characterized by the amplitudes of the sensor output signals. A second person necessarily causes a clear deviating amplitude distribution in the sensors 201, 202, and 203 arranged overhead.

For this type of evaluation, the evaluating unit 10 must provide a uniform sensor supply voltage. Similarly, in this context, the sensor groups, as shown in FIG. 6 and FIG. 7, must be selected with equal component scattering or tolerance values.

Figure 7:
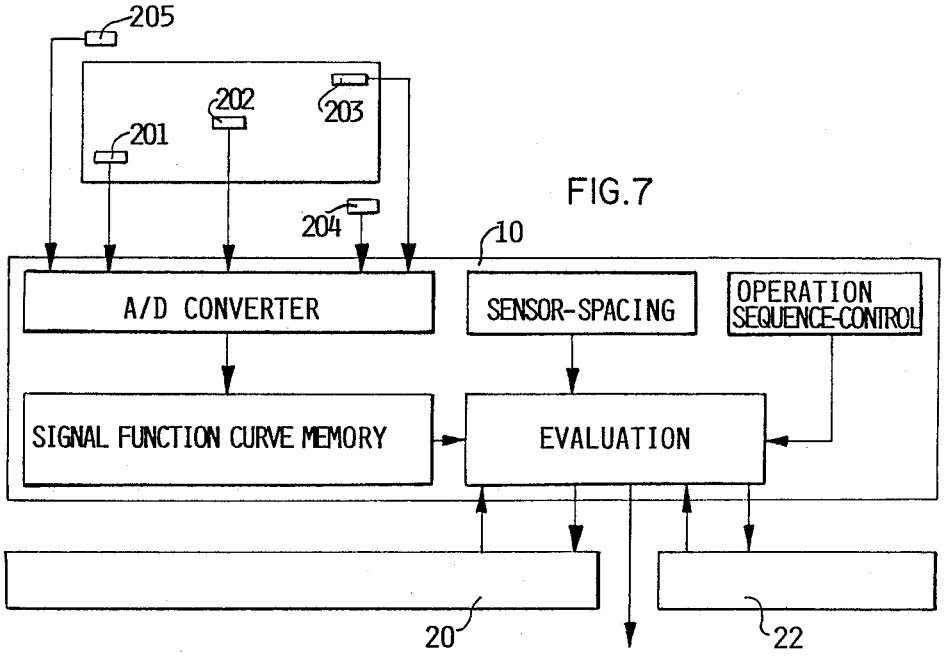
FIG. 7 is an evaluation apparatus for the structure of FIG. 6.

FIG. 7 also relates to the sensor arrangement shown in FIG. 6. It shows a simple variation possibility how the evaluating unit 10 may be connected in circuit to known entry control units and barrier control units.

This has the advantage that the evaluating unit is universally installable.

By means of the invention an arrangement for singling-out has now been achieved which, in addition to fulfilling all the functions of conventional arrangements, not only can be considerably less expensively produced, comprises a higher functional security and may be easily combined with nearly all existing security arrangements and structural conditions, but also gives the unauthorized person and his necessarily authorized helper an incalculable risk of being discovered during any attempt to overcome the arrangement and offers a much higher deterrence compared to the conventional sluices which are easy to figure out and thereby offers greater security against unauthorized entrance.

Furthermore, without any further expenditure, an unomittable escape path or a widened transport path may be integrated into the system.

I claim:

1. A system for determining the number of persons within a space and the direction of movement of such persons through said space to be monitored, comprising at least two infrared sensors ($S_1$–$S_n$) for measuring a deviation of the ambient temperature from the body heat of persons passing through to provide respective output signals, evaluating means (10) connected to said infrared sensors for receiving said output signals from said infrared sensors ($S_1$–$S_n$) for evaluation, entry control means (20) connected to said evaluating means for receiving evaluated signals representing the number of people passing through, said evaluation taking a sensor spacing between sensors into account, and wherein said evaluating means (10) determine a time progression of said deviation dependent on the movement velocity of the persons and dependent on the energy of the infrared radiation.

2. The system of claim 1, wherein said infrared sensors comprise at least two IR-sensors arranged behind one another in a passage direction, and at least two further IR-sensors arranged next to one another perpendicularly to the passage direction.

* * * * *